United States Patent [19]

Sakano et al.

[11] 4,368,528

[45] Jan. 11, 1983

[54] PICKUP CARTRIDGE

[75] Inventors: Akio Sakano; Kunio Shikakura, both of Tokyo; Hideshi Tamaru; Kimiyoshi Yoshida, both of Kanagawa, all of Japan

[73] Assignee: Sony Corporation, Tokyo, Japan

[21] Appl. No.: 190,976

[22] Filed: Sep. 26, 1980

[30] Foreign Application Priority Data

Oct. 12, 1979 [JP] Japan ..... 54-132168

[51] Int. Cl.[3] ..... H04R 11/12

[52] U.S. Cl. ..... 369/136; 369/149

[58] Field of Search ..... 369/135, 136, 139, 149

[56] References Cited

U.S. PATENT DOCUMENTS 2,456,388 12/1948 Cornwell ..... 369/149
4,140,886 2/1979 Itoh ..... 369/136
4,177,360 12/1979 Fujimoto et al. ..... 369/136
4,271,335 6/1981 Okura ..... 369/136

FOREIGN PATENT DOCUMENTS 107400 8/1980 Japan ..... 369/136

*Primary Examiner*—Bernard Konick
*Assistant Examiner*—Donald McElheny, Jr.
*Attorney, Agent, or Firm*—Hill, Van Santen, Steadman, Chiara & Simpson

[57] ABSTRACT

A pickup cartridge comprises a magnetic circuit having an air gap, a coil wound on the magnetic circuit and a cantilever having a permanent magnet inserted in to the air gap. In this case, the magnetic circuit comprises a delta-shaped jointless core having the air gap at its vertical angle, and the coil is inserted through the air gap and fixed to the core.

8 Claims, 4 Drawing Figures

PICKUP CARTRIDGE

BACKGROUND OF THE INVENTION

1. Field of the Invention

This invention relates generally to a pickup cartridge, and more particularly to an improved pickup cartridge provided with a novel magnetic circuit.

2. Description of the Prior Art

A prior art pickup cartridge, especially a so-called moving magnet type pickup cartridge includes such a magnetic circuit which generally consists of four pole pieces arranged in relation of 90° with one another to form an air gap, yokes each being bent at right angles from each of the pole pieces, a coil wound on each of the yokes, and a short core for magnetically short-circuiting the ends of each of the yokes after the respective coils are wound on the respective yokes. Accordingly, it is necessary for the prior art pickup cartridge to provide means for integrally forming the pole pieces of different angles and yokes, and also to provide the short cores separately, which results in that the construction and assembly of the pickup cartridge becomes complicated.

Further, since the magnetic circuit or path of the prior pickup cartridge is formed of the pole pieces, yokes and short cores, the magnetic circuit or path becomes long and has high magnetic resistance or reluctance. Thus, such a defect appears that the output characteristics can not be selected so large.

In the art there has been also proposed such a picku cartridge, in which several thin core plates or layers each having no joint and being of approximately U-shape, are laminated and detecting coils are directly or with no bobbins wound on the leg portions of the laminated core. According to the above pickup cartridge having the above magnetic circuit, it is ascertained that the high frequency characteristics and so on upon a record reproduction become good.

With such the above kind of pickup cartridges, when the coil is wound on the core, at first the core is griped by a chuck or the like to determine its rotation center, while a coil wire fed from a coil wire drum provided on a part of a coil winding machine is introduced to a nozzle disposed between the leg portions of the core. Then, while the nozzle is moved, one leg portion of the core, generally the core is rotated to directly wind the coil wire from the nozzle on the one leg portion of the core as a detecting coil. By the similar operation, on the other leg portion of the core, a detecting coil is also wound.

According to the above core, since the coils are directly wound on both leg portions of the core, there occur such a defect that the insulating coating layer of the coil wire is easily damaged by the tip end of the nozzle, sharpe edges of the leg portions or the like during the winding process, and also that the insulating layer on the leg portions are frequently damaged. As a result, there occurs frequently such a trouble that the short-circuiting is caused between the detecting coil and the core, and between the wires of the coil. By the above defects, the yield of the worked magnetic circuit is lowered and the working property of the winding process per se is poor.

OBJECTS AND SUMMARY OF THE INVENTION

Accordingly, an object of the present invention is to provide a pickup cartridge free of the defects inherent to the prior art pickup cartridge.

Another object of the invention is to provide a pickup cartridge which has a short magnetic path and hence a low reluctance.

A further object of the invention is to provide a pickup cartridge, in which a coil previously provided as a separate one is assembled to each of both leg portions of a jointless core from its air gap so that their assembling is easy and it is free of such a trouble that the coil wire is cut off and so on.

A yet further object of the invention is to provide a pickup cartridge in which a coil is located as close as possible to an air gap where a magnet is disposed and the clearance between the coil and core is selected small to thereby introduce the variation of magnetic flux to the coil effectively.

According to an aspect of the present invention, a pickup cartridge having first and second jointless cores, each consisting of a pair of leg members which are connected by a short core member, said first and second jointless cores being connected so as to make a right angle with each other at said short core members, coils wound on each of said leg members, and a cantilever having a permanent magnet inserted into an air gap formed by free end portion of each of said leg members, said pair of leg members of first and second cores being arranged so as to oppose to each other and an interval of said pair of leg members becoming successively narrow to the direction of free end thereof from short core side, and said coils being inserted through said air gap and fixed on said each leg member.

The other objects, features and advantages of the present invention will become apparent from the following description taken in conjunction with the accompanying drawings through which the like references designate the same elements and parts.

DESCRIPTION OF THE PREFERRED EMBODIMENT

Hereinafter, the present invention will be described with reference to the attached drawings.

Figure 1:
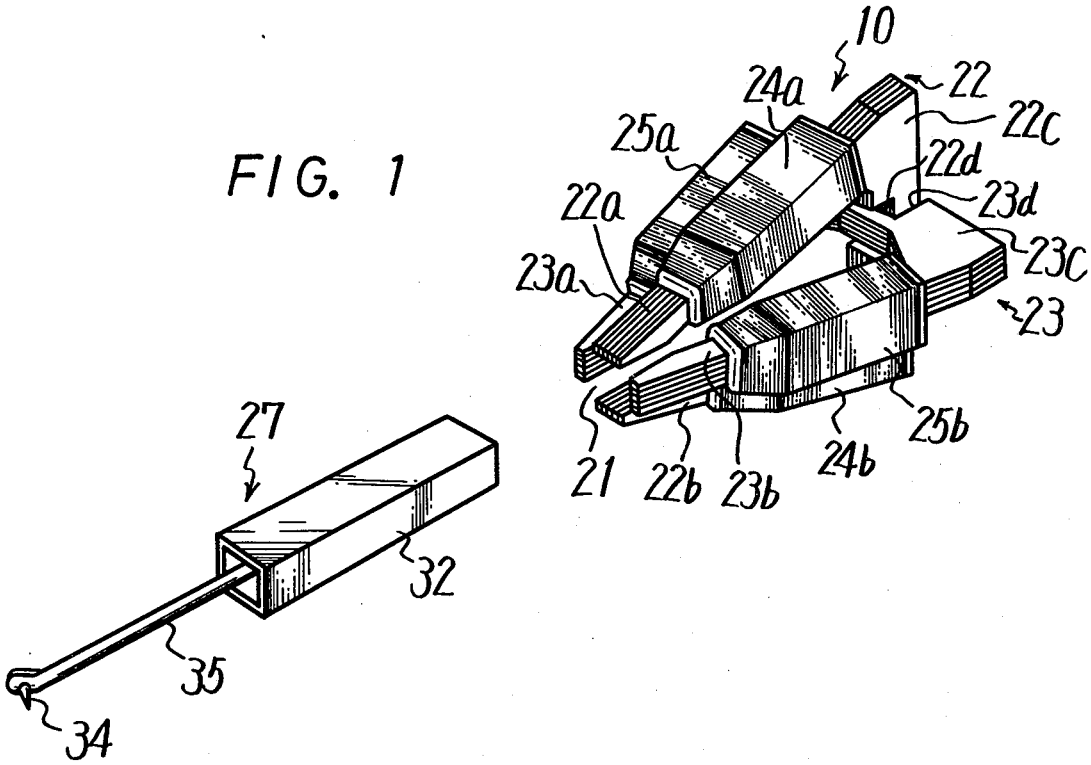
FIG. 1 is a perspective and exploded view showing an example of the pickup cartridge according to the present invention.

As shown in FIG. 1, an example of a stereophonic pickup cartridge 10 according to the invention is formed of a pair of magnetic cores 22 and 23 with an air gap 21, detecting coils 24*a;* 24*b* and 25*a;* 25*b* wound on the respective magnetic cores 22 and 23, and a vibrating body 27. In more detail, as shown in FIG. 2, one magnetic core 23 includes a pair of leg members 23*a*, 23*b*, a short core member 23*c* connecting the pair of leg members 23*a*, 23*b* at their one ends and a recess 23*d* formed on the short core member 23*c* for the core 23 to be coupled to the other core 22.

Figure 2:
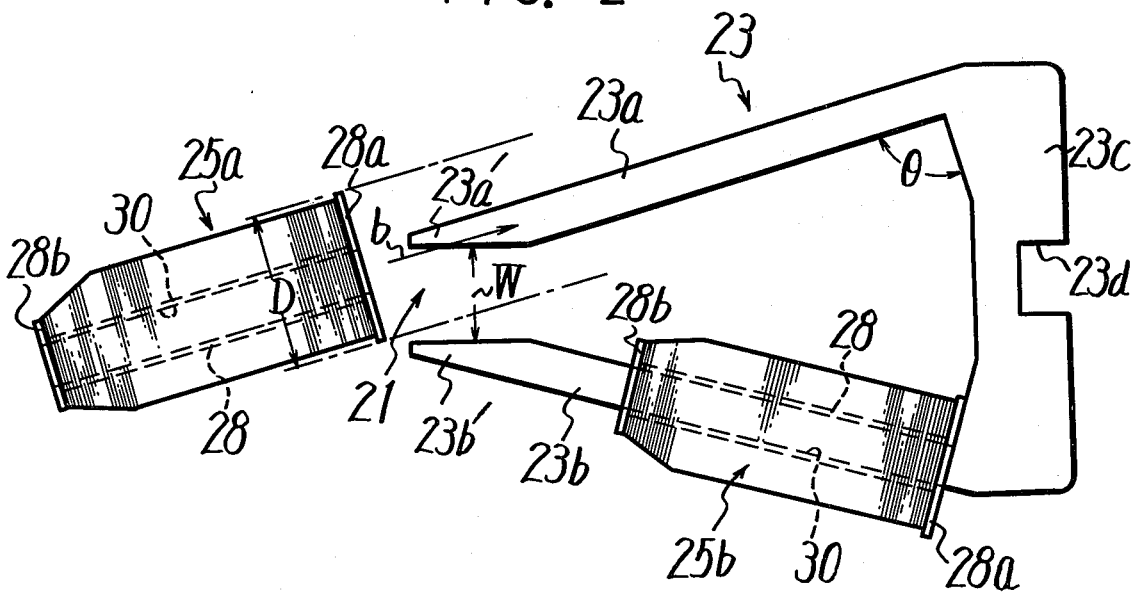
FIG. 2 is a plan view showing in an enlarged scale the magnetic circuit and coils of the pickup cartridge shown in FIG. 1.

In the illustrated example of FIG. 2, the leg members 23*a* and 23*b* of the core 23 are extended from the short core member 23*c* to one side thereof with the distance therebetween narrow gradually so that the core 23 becomes substantially a delta shape as a whole. Further, the opposing surfaces of the free end portions 23*a'* and 23*b'* of the leg members 23*a* and 23*b* i.e. the inner surfaces of the tip ends of the pole pieces are respectively shaped to be horizontal flat surfaces to form an operating or air gap 21 therebetween. In this case, a distance W of the air gap 21 is selected as a predetermined length, and both leg members 23*a* and 23*b* are same in width and of a straight rod or plate shape.

According to the invention, the detecting coils 25*a* and 25*b*, which are previously provided as separate ones, are respectively inserted into the leg members 23*a* and 23*b* of the core 23 from the end portions 23*a'* and 23*b'* through the air gap 21 to such positions where the detecting coils 25*a* and 25*b* are symmetrical with respect to the center line between the leg members 23*a* and 23*b*. In FIG. 2, the detecting coil 25*b* is already inserted into the leg member 23*b* to the predetermined position, while the detecting coil 25*a* is shown at the position facing the free end portion 23*a'* of the leg member 23*a* to be inserted into the latter.

In the example of the invention shown the figure, the detecting coils 25*a* and 25*b* are each made by such a manner that a coil wire is wound on a thin bobbin 28 made of, for example, mold plastics. An inner bore 30 of the bobbin 28 is shaped to be substantially coincident with each of the leg members 23*a* and 23*b* in cross-shape, so that each of the detecting coils 25*a* and 25*b* is closely inserted into each of the leg members 23*a* and 23*b*. In this case, it may be possible if desired that adhesive agent or the like is used to fix the bobbin 28 of each of the detecting coils to each of the leg members 23*a* and 23*b*. Further, the leg members 23*a* and 23*b* are subjected to the insulating treatment except their free end portions.

In the illustrated example, the bobbin 28 has a large size of a flange 28*a* at the insertion side end and a small size of a flange 28*b* at the opposite end. The tip end portion or portion remote from the insertion side of each of the detecting coils is tapered or made small in diameter gradually as the tip end approaches. The diameter D of the flange 28*a* of the bobbin 28 at the insertion side is selected somewaht smaller than two times of the distance W of the air gap 21.

When the detecting coil 25*a* is inserted into the leg member 23*a* from the side of the end portion 23*a'* thereof along a line b in FIG. 2, the moving trace of the flange 28*a* is selected as shown by the one-dot chain lines in FIG. 2 to avoid the contact of the flange 28*a* with the free end portion 23*b'* of the other leg member 23*b*. The above is same for the case of the other detecting coil 25*b*. In this example, each of the cores 22 and 23 is made by laminating a number of thin magnetic pieces.

As shown in FIG. 1, the core 23 with the coils and assembled as above is coupled to the other core 22 which is prepared by the manner substantially same as that of the core 23. That is, the recesses 22*d* and 23*d* formed on short core members 22*c* and 23*c* of cores 22 and 23 are engaged with each other such that the short core members 22*c* and 23*c* become perpendicular with each other. After the assembling, both cores 22 and 23 are firmly fixed by suitable adhesive agent.

Figure 3:
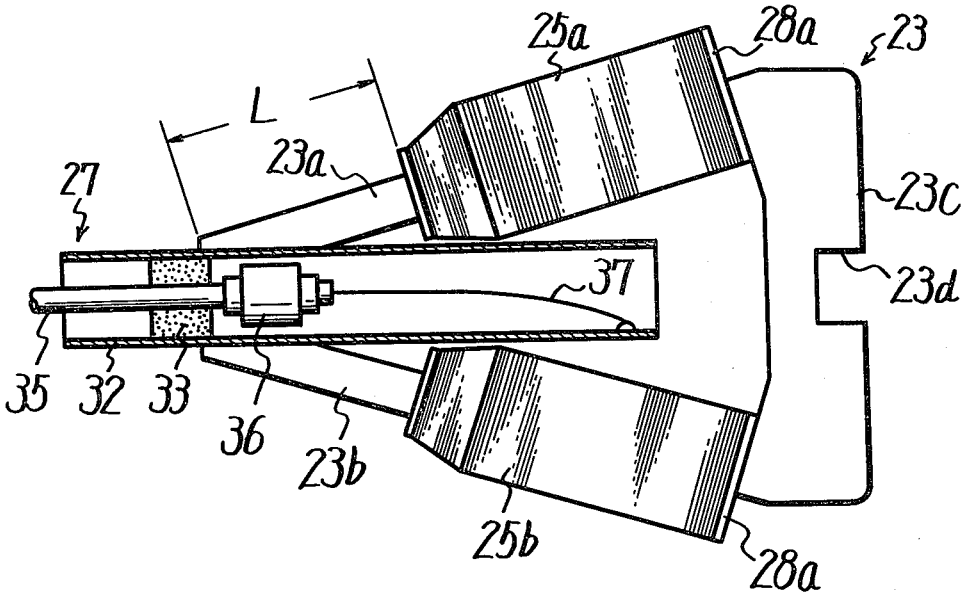
FIG. 3 is an enlarged plan view showing partially in cross-section such a state in which a vibrating body having a contilever is inserted into the magnetic circuit with a coil wound thereon.

After the coils are respectively inserted into the cores and the respective cores are coupled with each other as described above, the vibrating body 27 is assembled to the cores through the air gap 21 as shown in FIG. 3. The vibrating body 27 consists of a hollow sleeve 32 with rectangular cross-section, a cantilever 35 which is supported at its one end portion by a damper 33 provided in the hollow sleeve 32 and has at its other end a stylus 34 (refer to FIG. 1) to be in contact with the groove of a record disc (not shown), and a permanent magnet 36 fixed to one end portion the cantilever 35 in the sleeve 32. The end of the cantilever 35 in the sleeve 32 is fixed to the sleeve 32 by a tension wire 37. When the vibrating body 27 is assembled to the cores, the magnet 36 is positioned at the free end portions of the respective cores i.e. air gap 21 as shown in FIG. 3.

As described above, according to the present invention, since the detecting coils each of which is previously provided as an independent coil, are loaded or inserted into the both leg members of each jointless core from the free end of the leg members through the air gap, the mass-production of the core can be improved much as compared with the case where a coil wire is directly wound on a magnetic core as in the prior art, and also the occurrence of inferior goods such as cutting off of the coil wire can be decreased.

Further, according to the invention the leg members of the cores including the portions into which the detecting coils are inserted are selected uniform in cross-section, so that the distance between the respective bobbins of the coils and the respective leg members of the cores can be made sufficiently small with the result that the electromagnetic coupling between the coils and the cores can be made close to avoid the lowering of output caused by the bobbins.

Further, according to the invention since each of the coils 24*a*, 24*b*, 25*a* and 25*b* is selected gradually small in diameter at the side of the magnetic gap of the cores 22 and 23 so as to be parallel to the sleeve 32 of the vibrating body 27 as described above, the length L of the portion of each of the leg members 22*a*, 22*b*, 23*a* and 23*b* where the coil is not located can be made as short as possible with the result that the useless leakage magnetic flux from each of the leg members 22*a*, 22*b*, 23*a* and 23*b* can be reduced, and the sufficient number of turns of coils can be presented without increasing the diameter of the coil i.e. lowering the electromagnetic conversion efficiency.

Further, due to the fact that the high electromagnetic conversion efficiency is presented by the invention, the number of turns of the coil can be suppressed, hence it is avoided that the inductance, distribution capacity and load capacity are increased unnecessarily, and both the frequency characteristic and the output can be improved.

Figure 4:
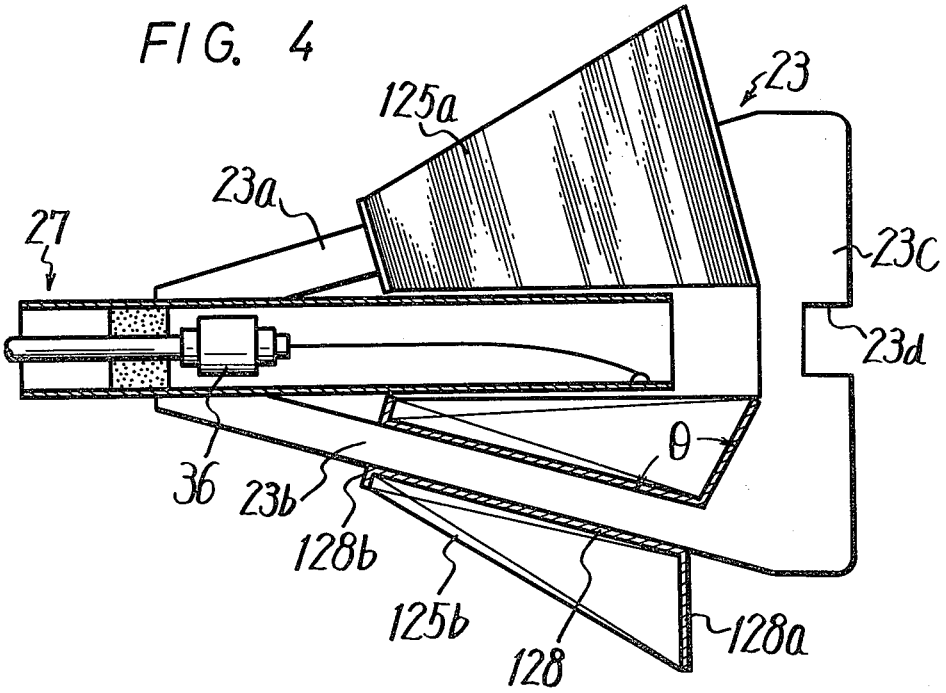
FIG. 4 is an enlarged plan view showing partially in cross-section another example of the combination of the magnetic circuit with a coil thereon and a vibrating body.

In the example of the invention shown in FIGS. 2 and 3, one end portion of each of coils 24*a*, 24*b*, 25*a* and 25*b* near the air gap 21 is tapered and each of the coils is got near the air gap 21 i.e. magnet 36. It is, however, possible that as shown in FIG. 4 each of coils 125*a* and 125*b*, corresponding to the above coils 24*a* to 25*b*, is made different in diameter gradually over its full length or given with a taper over its whole length. In this case, the number of turns of each of coils 125*a* and 125*b* is increased at the side of short core member 23*c* of core 23, so that it will be apparent that the output from the cartridge increases.

In the example of FIG. 4, since the radius of flange 128*a* of bobbin 128 for each of the coils at the side of short core member 23*c* is longer than the width of the air gap so that each of the coils is inserted into each of the leg members of the core along an arc about the free end of each leg member.

In the example of FIG. 4, an intersecting angle $\theta$ between each of the leg members 23*a* and 23*b* and the short core member 23*c* is selected larger than 90° or they continue with each other with the angle $\theta$ more than 90°, and the bobbin 128 has provided with flanges 128*a* and 128*b* at both ends thereof. In this case, one flange 128*a* is extended from the shaft or hub of the bobbin 128 at the angle same as the above intersecting angle $\theta$ to be in close contact with the short core member 23*c* of core 23.

According to the present invention constructed as above, each of the leg members 23*a* and 23*b* of delta shaped core 23 continues to its short core member 23*c* at the intersecting angle $\theta$ larger than 90°, and one of the flanges of the coil bobbin is formed to be extended from its hub at the angle same as the above angle, so that when the coil bobbin is inserted into each of the leg members, the above flange contacts closely with the short core member of the core. Therefore, the bobbin is held stably and each of the coils 125*a* and 125*b* can be mounted on the core with no loss. Accordingly, the number of turns of coils can be increased, the length of the magnetic path becomes short and hence the reluctance becomes low. Further, the coils can be located with good symmetry so that a large output can be obtained and crosstalks are reduced with the result that the efficiency of the cartridge can be improved.

It will be apparent that many modifications and variations could be effected by one skilled in the art without departing from the spirits or scope of the novel concepts of the present invention, so that the spirits or scope of the invention should be determined by the appended claims only.

We claim as our invention:

1. In a pickup cartridge having first and second jointless cores, each consisting of a pair of leg members which are connected by a short core member, said first and second jointless cores being connected so as to make a right angle with each other at their respective short core members, coils mounted around each of the leg members, and a cantiliver having a permanent magnet inserted into an air gap formed by adjacent free end portions of said leg members, said pair of leg members of each of said first and second cores being arranged so as to oppose each other and the spacing between each said pair of leg members becoming successively narrow toward the direction of the free end thereof, and said coils being inserted through said air gap and fixed on said each leg member.

2. A pickup cartridge as claimed in claim 1, wherein each of said pair of leg members is made to have a straight line shape with a uniform width.

3. A pickup cartridge as claimed in claim 1, wherein each of said cores is of a delta shape with said air gap as its one top.

4. A pickup cartridge as claimed in claim 1, wherein the width of said air gap is selected somewhat larger than the radius of said coil.

5. A pickup cartridge as claimed in claim 1, wherein each of said coils consists of a coil wire and a bobbin on which said coil wire is wound.

6. A pickup cartridge as claimed in claim 5, wherein said short core member and leg member of said core have a continuing portion with an intersecting angle larger than 90° and said bobbin contacts with said continuing portion.

7. A pickup cartridge as claimed in claim 1, wherein each of said cores is of a delta shape with said air gap as its one top and each of said coils mounted on each of said leg members is so selected that the diameter of the winding at the side of said air gap is smaller than that at the side of said short core member.

8. A pickup cartidge as claimed in claim 7, wherein at least the diameter of the winding at the side of said air gap is selected to be along said cantilever.

* * * * *